US006367173B2

(12) United States Patent
Lancon

(10) Patent No.: US 6,367,173 B2
(45) Date of Patent: Apr. 9, 2002

(54) INTERFACE DEVICE FOR SPORTS APPARATUS

(75) Inventor: Bruno Lancon, Villy le Pelloux (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/756,699

(22) Filed: Jan. 10, 2001

(30) Foreign Application Priority Data

Jan. 28, 2000 (FR) ..... 00 01239

(51) Int. Cl.[7] ..... A43B 5/04; A43B 5/16; A63C 5/00

(52) U.S. Cl. ..... 36/122; 36/124; 280/604; 280/607

(58) Field of Search ..... 36/122, 123, 124, 36/125, 117.2, 117.3, 117.4; 280/604, 605, 607, 613, 617, 618, 626, 629, 630, 631, 633, 611

(56) References Cited

U.S. PATENT DOCUMENTS

| | | | | |
|---|---|---|---|---|
| 3,060,600 A | * | 10/1962 | Howe | 36/125 |
| RE25,472 E | * | 11/1963 | Howe | 36/125 |
| 4,273,355 A | * | 6/1981 | Storandt | 280/618 |
| 4,624,475 A | * | 11/1986 | Nowak et al. | 280/618 |
| 4,700,696 A | * | 10/1987 | Schoffstall | 280/613 |
| 4,725,069 A | * | 2/1988 | Stampacchia et al. | 280/607 |
| 5,318,320 A | | 6/1994 | Ramer | |
| 5,560,633 A | * | 10/1996 | McGowan | 280/607 |
| 5,813,689 A | * | 9/1998 | Mansure | 280/618 |
| 5,901,975 A | * | 5/1999 | Phipps | 280/618 |
| 6,163,984 A | * | 12/2000 | Faber et al. | 36/125 |

FOREIGN PATENT DOCUMENTS

| | | |
|---|---|---|
| FR | 2725631 | 4/1996 |
| FR | 2760375 | 9/1998 |

* cited by examiner

*Primary Examiner*—Anthony Stashick
(74) *Attorney, Agent, or Firm*—Greenblum & Bernstein, P.L.C.

(57) ABSTRACT

A connecting interface device adapted to be fixed on a boot and mounted pivotally on a sports apparatus which procures rear retention when climbing. The device includes a plate to which a boot is fixed, which is pivotally mounted on an axle in relation to the sports apparatus. This device also includes a base plate that is pivotally mounted in relation to the plate about an axis. This base plate is arranged beneath the plate and includes a housing for receiving a climbing wedge that is mounted so as to be inserted between the plate and the base plate. This device finds an application in particular in snowshoes and cross country skis.

14 Claims, 3 Drawing Sheets

34
31
2
23
35
36
37
33
12
22
1
10
32

INTERFACE DEVICE FOR SPORTS APPARATUS

BACKGROUND OF THE INVENTION

1. Field of the Invention

The present invention relates to a connecting interface device adapted to be fixed on a boot and pivotally mounted on a sports apparatus, which procures rearward retention when climbing. The connecting interface device of the invention makes it possible to adopt a climbing position in which the boot maintains an inclined position in relation to the sports apparatus. In particular, this invention is adapted to equip snowshoes and skis that can be provided with skins, or any other sports apparatus adapted to be used for climbing.

2. Description of Background and Relevant Information

Numerous pivoting plate systems equipped with a climbing wedge exist in the state of the art.

The wedge, which often is a wire, is inserted in the raised position between the sports apparatus and the pivoting plate. It can be mounted pivotally either on the sports apparatus, or on the plate. However, all these systems punch the sports apparatus when the user presses with his foot on the climbing wedge. This even goes as far as breaking certain back country skis. The invention described in the document FR 2 725 631 proposes a wedge pivoting about a vertical axis that positions a protruding piece beneath the pivoting plate. However, this protrusion strongly biases the wedge fastener in traction on the sports apparatus.

Generally speaking, all of the existing systems require the manufacture of the sports apparatus in a material that has good mechanical properties, and therefore an expensive material, or reinforcing the sports apparatus with reinforcements that remain expensive to implement.

SUMMARY OF THE INVENTION

One of the objects of the present invention is to propose a connecting interface device that does not require using special reinforcements on the sports apparatus, and that makes it possible to optimize the materials used for the sports apparatus.

Another object of the invention is to reduce the overall cost of the materials used for the connecting interface device and sports apparatus assembly.

To achieve these objects, the connecting interface device includes a plate on which the boot is fixed, and which is journalled in a known manner on the sports apparatus. The device also includes a base plate that is pivotally mounted in relation to the plate on an axle transverse to the sports apparatus, and which is arranged beneath the plate. The climbing wedge is then arranged so as to be inserted between the base plate and the plate. Thus, the pressure exerted by the boot on the climbing wedge is recovered by the material constituting the base plate. This device therefore makes it possible to limit the use of materials having high mechanical resistance for the plate, and to optimize accordingly the materials used for manufacturing the sports apparatus.

BRIEF DESCRIPTION OF DRAWINGS

The invention will be better understood and other advantages thereof will become apparent from the description, with reference to the annexed drawings that are an integral part thereof. The description shows, by way of non-limiting examples, certain preferred embodiments.

DETAILED DESCRIPTION OF THE INVENTION

Figure 1:
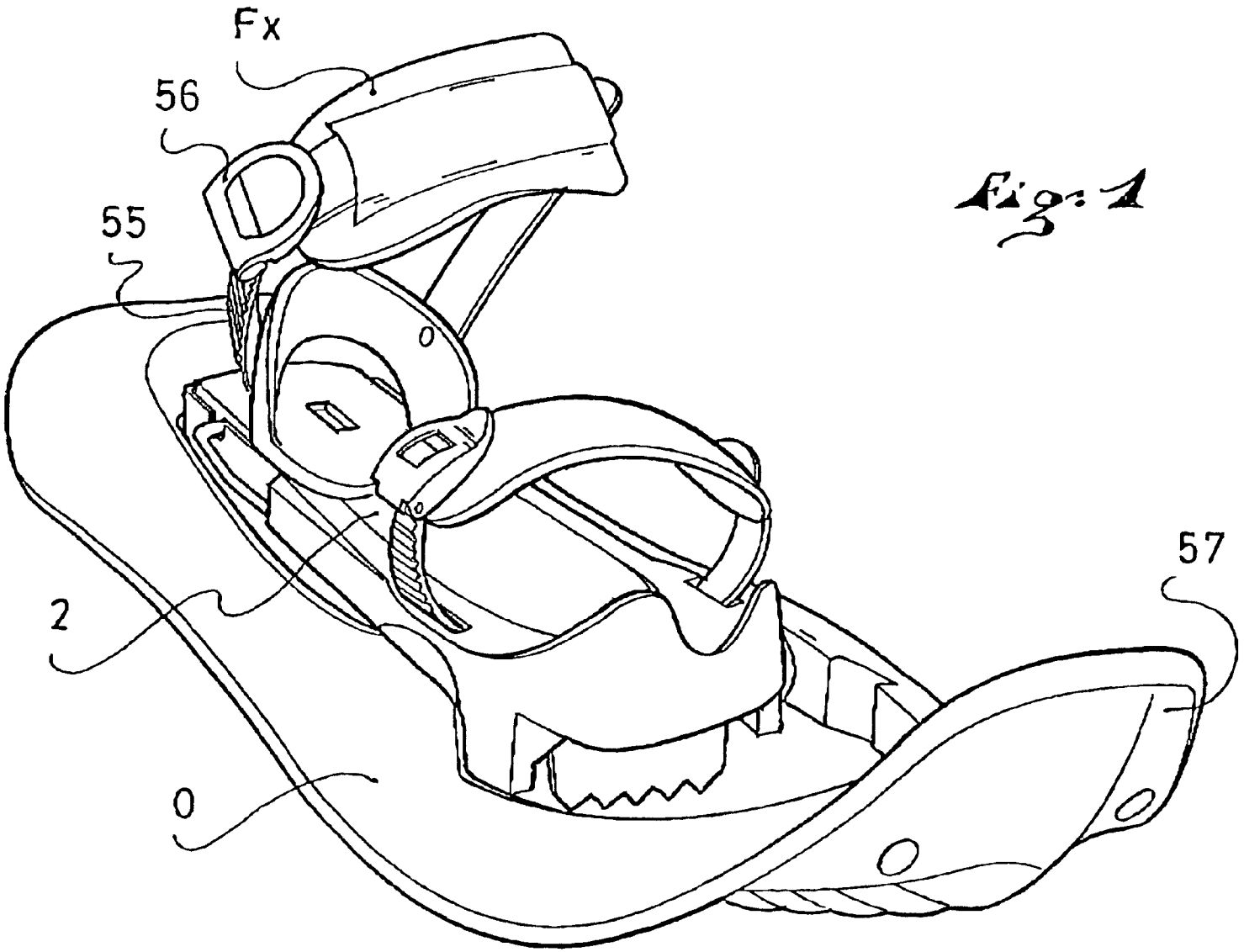
FIG. 1 schematically shows a front three-quarter general view of a snowshoe equipped with the connecting interface device.

FIG. 1 shows a general view of the sports apparatus/connecting interface device assembly, which in this case is a snowshoe, including a frame 0 on which a plate 2 is hingedly mounted. The user's boot is fixed on the plate 2 by a fixing arrangement Fx, affixed to the plate 2, which can be constituted, for example, of a notched strap 55 and a closure buckle 56. The fixing arrangement Fx surrounds the boot preferably at the front of the boot as well as at the instep. It is contemplated that the fixing arrangement Fx can be different, including in accordance with the known prior art, in snow shoes and bindings of cross country skis. The selection of the fixing arrangement Fx is absolutely not intended to be limiting for the present description and invention. The axis along which the plate 2 is hingedly mounted is transverse to the sports apparatus, and preferably located next to the shovel 57.

Figure 2:
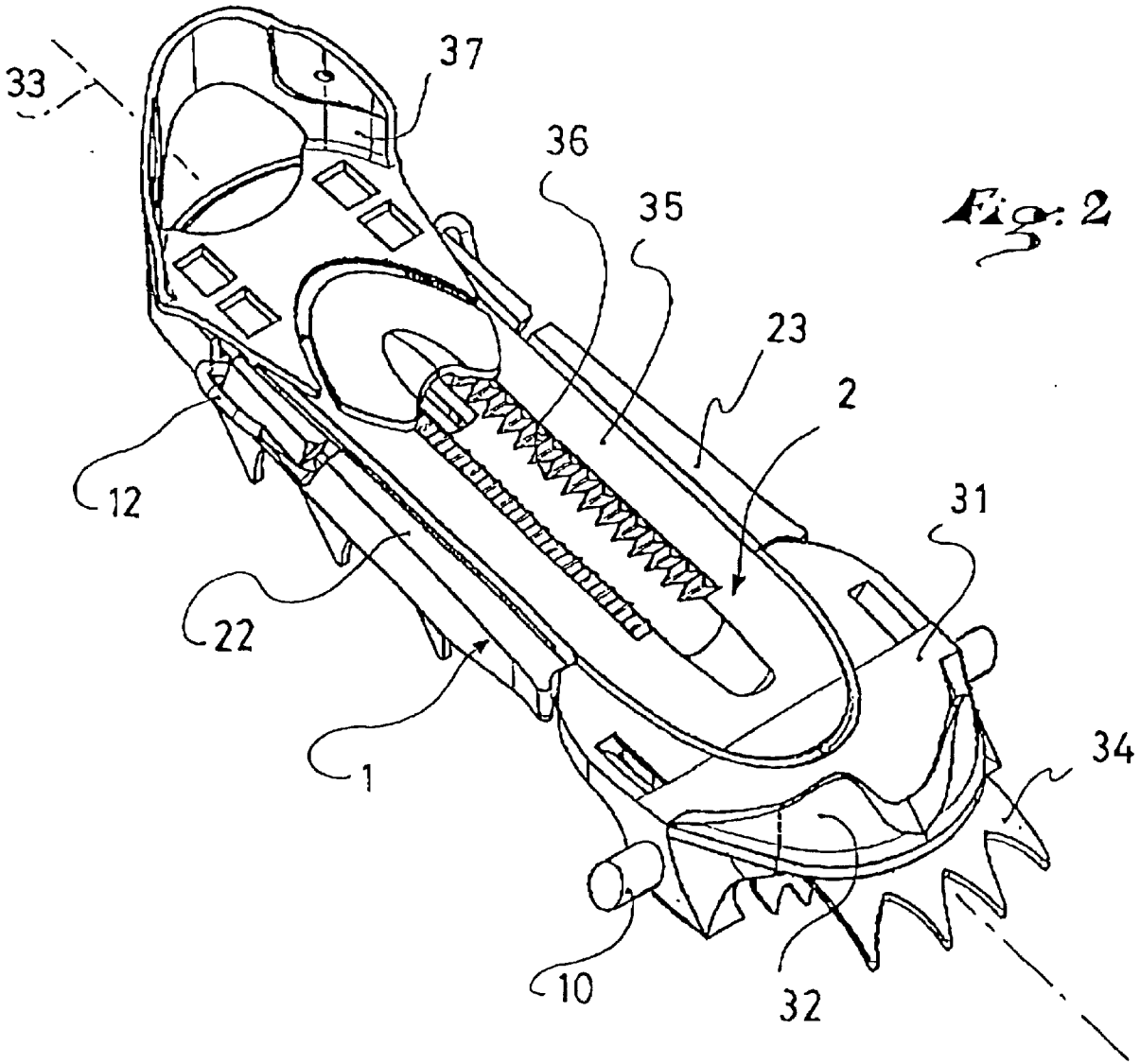
FIG. 2 schematically shows a front three-quarter view of the connecting interface device alone.

FIG. 2 shows a front three-quarter perspective view of the connecting interface device alone. The boot fixing arrangement previously described is not shown. The plate 2 is hingedly mounted on an axle 10 transverse to the sports apparatus. The plate 2 includes a wide portion 31, located at the front in the area of the axle 10, which serves as a support for the front portion of the boot, and more specifically for the portion located between the front end and the metatarsophalangeal articulation of the foot. The plate 2 also includes, at its front end, at least one frontal edge 32 that extends upwardly along a height that is substantially equal to, even greater than the height of the sole of the boot, at its front end.

In the preferred embodiment shown, the frontal edges 32 are two in number and are positioned so as to be substantially symmetrical with respect to the longitudinal axis 33 of the connecting interface device. These frontal edges 32 serve to retain the boot toward the front, especially when the connecting interface device is used in cramponing, on hard snow or ice. This cramponing is made possible due to the teeth 34 that are fixed on the wide portion 31 of the plate 2, and fixed substantially beneath at least one front edge 32.

The plate 2 also includes an adjusting band 35 that extends, rearward of the wide portion 31, along the longitudinal axis 33. On this band 35 is slidably mounted the heel-piece 37 including means, not shown, for fixing the rear of the boot. The position of the heel-piece 37 can be adjusted according to known means of the prior art, such as a rack 36, so as to adapt to the length of the boot.

This figure shows the base plate 1 that is arranged beneath the plate 2. This base plate 1 includes at least one lateral edge 22 that extends upwardly along a height substantially identical to the thickness of the plate 2. The lateral edge 22 is preferably positioned at the level of the adjusting band 35 and outside this band 35, so that it partially surrounds the plate 2 at the level of the adjusting band. The lateral edge 22 is preferably positioned as close to the plate 2 as possible in order to reinforce the lateral stability thereof.

In this preferred embodiment shown, the lateral edges 22, 23 are located on both sides of the plate 2 so as to laterally extend the support surface of the boot provided by the plate 2. As the climbing wedge 12 is in the lowered position, the plate 2 is parallel to the base plate 1 and is nested therein. Advantageously, the plate 2 is complementary of the base plate 1 to cooperate with the base plate 1.

Figure 3:
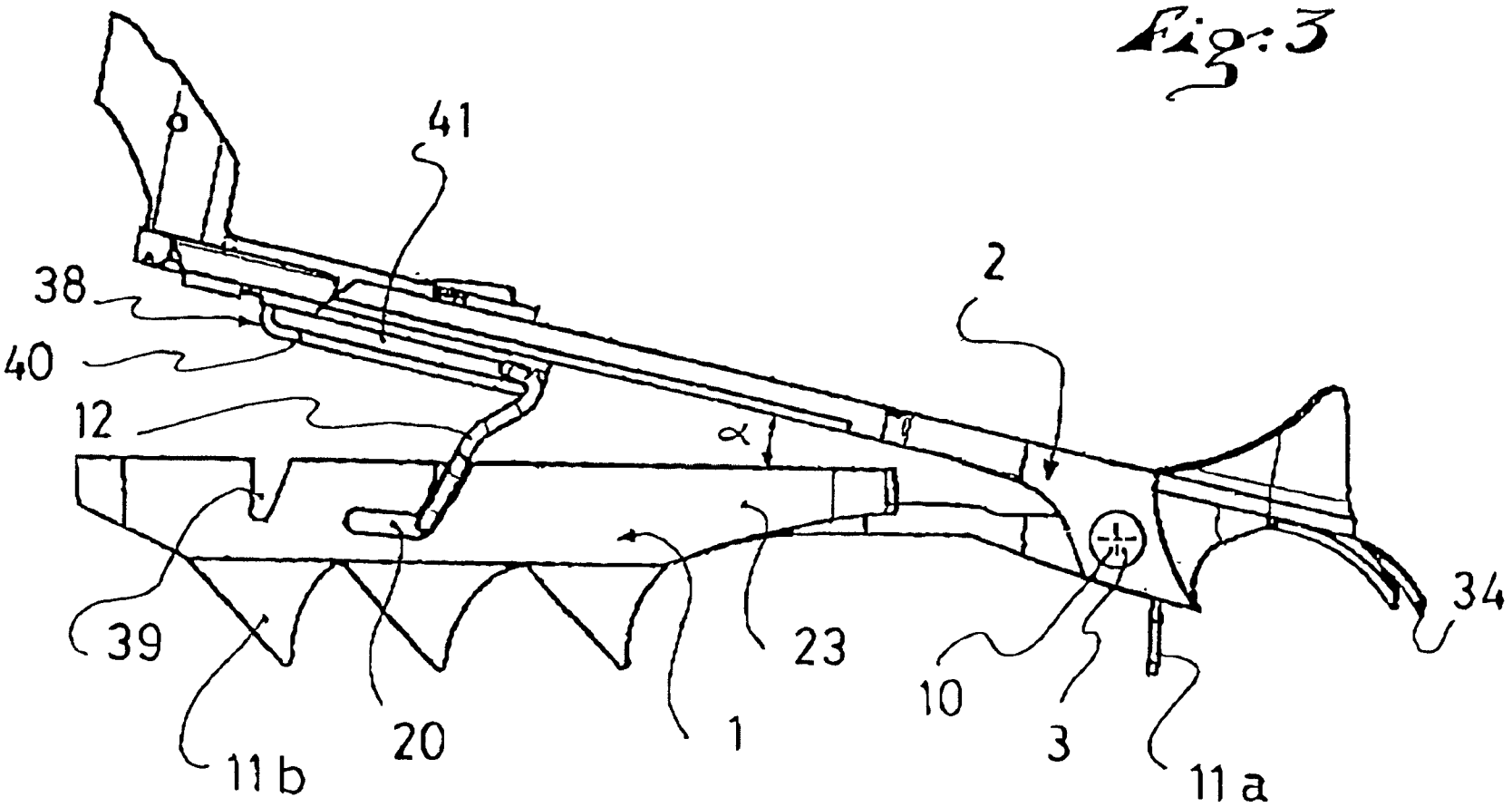
FIG. 3 schematically shows a side view of the connecting interface device in the climbing position.

In FIG. 3 the connecting interface device is shown when the climbing wedge 12 is in the raised position. Once again, the plate 2 is hinged about an axle 10 transverse with respect to the interface device. The base plate 1 is pivotally mounted with respect to the plate 2 along an axis 3 transverse to the sports apparatus, and therefore transverse to the device.

In the present embodiment shown, the axle of rotation 10 of the plate 2, with respect to the sports apparatus, merges with the axis of rotation 3 of the plate 2 with respect to the base plate. This arrangement considerably simplifies the embodiment of the invention since there is only one axis that allows two different rotations. It is contemplated according to the invention that there may well be two different rotational axes. The climbing wedge 12 is arranged so as to be inserted between the base plate 1 and the plate 2 in order to maintain, in the raised position, an angle of inclination $\alpha$ of the plate 2 with respect to the base plate 1 about the axis 3. The climbing wedge can be made, for example, of a stainless steel wire 4 millimeters in diameter, twisted in a U-shape, and the two ends of which are curved so as to form an axis. The wedge 12 moves from the raised position to the lowered position by pivoting bout an axis. In the raised position, the portion of the climbing wedge 12 in contact with the plate 2 is advantageously positioned in the heel zone of the boot in order to avoid flexing the plate 2. Therefore, the plate 2 can be made of inexpensive materials.

The base plate 1 includes a housing 20 adapted to pivotally maintain the climbing wedge 12 along a transverse axis. Moreover, the plate 2 includes a translational guiding 38 of the climbing wedge 12. To receive the climbing wedge 12 in the lowered position, the base plate 1 includes a scallop 39. This scallop 39 can be indistinctly positioned at the front or at the rear of the housing 20 depending upon whether the climbing wedge 12 is lowered frontwardly or rearwardly.

It is contemplated, according to the invention, that an inverse configuration can be made, where the climbing wedge 12 is fixed on the plate 2. In this case, the plate 2 would include a housing adapted to pivotally maintain the climbing wedge 12, and the base plate 1 would include a translational guiding of the climbing wedge 12.

Whether one or the other of the two previously described configurations is selected, the translational guiding system 38 advantageously includes a retaining bar 40 that makes it possible to maintain the angle $\alpha$ at a constant value. In fact, the retaining bar 40 forms, together with the support on which the translational guiding system 38 is fixed, a recess 41 that is located between the retaining bar 40 and the support. The climbing wedge is then slipped into this recess 41. The climbing wedge thus constitutes a rigid connection between the plate 2 and the base plate 1.

As for the translational guide 38, respecting this constructional arrangement makes it possible, when the foot fixed on the plate 2 is lifted, to also lift the base plate 1, regardless of the position of the wedge.

This result is particularly interesting with respect to the cramponing fiction of the connecting interface device with the retaining teeth 11*a,* 11*b,* that are fixed on the base plate 1. When the climbing wedge 12 is in the lowered position, the retaining teeth 11*a,* 11*b,* remain flat beneath the foot and pivot with the latter by behaving like so-called "mobile" crampons known from the prior art. When the climbing wedge 12 is in the lifted position, the retaining teeth 11*a,* 11*b,* keep a constant inclination angle $\alpha$ with respect to the plate 2, regardless of the pivoting position of the foot about the axle 10 during walking stride. When the foot is in support on the snow, the retaining teeth 11*a,* 11*b,* are in contact with the snow, and therefore in a good position to ensure their retaining function. Moreover, the foot does have an inclination, necessary for the climbing comfort, with respect to the sports apparatus on which the base plate 1 takes support. When the foot is in the pivoting phase, for a pivoting angle greater than $\alpha$, it drives along the retaining teeth 11*a,* 11*b,* which are no longer in contact with the snow, and thus facilitates the sliding displacement of the sports apparatus on the snow.

This is an advantage over the prior art in which a selection between grip and sliding must be made. Indeed, with the traditional crampons affixed to the sports apparatus, the grip is obtained when the foot presses on the apparatus, but at the expense of the sliding phase during the stride. Conversely, with crampons affixed to the hinged fixing plate, the sliding phase is obtained but at the expense of the grip, for the climbing wedge also raises the crampons.

To obtain an optimum grip, at least one retaining tooth 11*a* can be advantageously arranged on the base plate 1, and transversely with respect to the base plate 1. These retaining teeth 11*a* can be numerous, positioned substantially in the area of the axis 3, and can be oriented substantially perpendicular to the base plate 1 toward the bottom. These teeth contribute to the grip when climbing, when the foot is in the impulse phase of the walking stride, and the retaining teeth 11*b* are no longer in contact with the snow.

One can also arrange at least one retaining tooth 11*b* so as to be substantially parallel to the longitudinal axis 33 of the device. This retaining tooth 11*b* serves to grip when the foot is in support on the sports apparatus. The retaining teeth 11*b* can be arranged so as to be substantially symmetrical about the longitudinal axis 33 and in the area of the heel zone of the boot, and more generally in the rear half-length of the boot.

By way of illustrative but non-limiting example, the plate 2 can be made of an injected thermoplastic material, in particular polypropylene or polyamide, i.e., an inexpensive material, whereas the base plate 1 can be made of an injected thermoplastic material, in particular polyacetal, and has a perforated structure facilitating the evacuation of snow through the base plate 1.

This material has very good mechanical properties and thus makes it possible to recover the localized pressure exerted by the climbing wedge 12 on the housing 20 reserved for this purpose in the base plate 1. One can also envision a dual-material injection of the base plate 1 by only injecting the material having good properties around the housing 20. In addition, the perforated structure of the base plate 1 reduces the manufacturing cost.

Thus, the base plate 1, which has a certain rigidity, properly distributes the pressure exerted on the frame of the snowshoe or the cross country ski. One can thus obtain a snow shoe frame in polypropylene, inexpensive flexible material, or on a cross country ski without a fixing reinforcement.

The present invention is not limited to the specific embodiments described hereinabove, which are provided for guidance only, but encompasses all similar or equivalent embodiments.

The instant application is based upon French Patent Application No. 00 01239, filed Jan. 28, 2000, the disclosure of which is hereby incorporated by reference thereto in its entirety, and the priority of which is hereby claimed under 35 U.S.C. §119.

What is claimed is:

1. A connecting interface device adapted to have a boot affixed with respect thereto and mounted pivotally on a sports apparatus which procures rear retention when climbing, said device comprising:

a plate including a fixing arrangement for the boot, an axle extending transversely to the apparatus, said plate being hingedly mounted on the apparatus by said axle;

a climbing wedge movable between at least two positions, said two positions including a raised position, which increases an inclination angle of said plate with respect to the apparatus, and a lowered position; and a base plate pivotally mounted, in relation to said plate, along an axis transverse to the apparatus, said base plate being arranged beneath said plate.

2. A connecting interface device according to claim 1, wherein the climbing wedge is arranged so as to be inserted between the base plate and the plate to maintain, in the raised position, an inclination angle of the plate with respect to the base plate about the axis.

3. A connecting interface device according to claim 1, wherein the axle of rotation of the plate with respect to the apparatus is merged with the axis of rotation of the plate with respect to the base plate.

4. A connecting interface device according to claim 1, wherein the base plate includes a housing adapted to pivotally maintain the climbing wedge, and wherein the plate includes a translational guiding of the climbing wedge.

5. A connecting interface device according to claim 1, wherein the plate includes a housing adapted to pivotally maintain the climbing wedge, and wherein the base plate includes a translational guiding of the climbing wedge.

6. A connecting interface device according to claim 1, wherein the plate is complementary of the base plate, so as to perfectly cooperate with the base plate when the climbing wedge is in the lowered position.

7. A connecting interface device according to claim 1, wherein the base plate includes at least one lateral edge that extends upwardly along a height substantially identical to a thickness of the plate, and which partially surrounds the plate.

8. A connecting interface device according to claim 1, wherein the base plate includes at least one retaining tooth.

9. A connecting interface device according to claim 8, wherein at least one tooth is mounted transversely with respect to the base plate.

10. A connecting interface device according to claim 8, wherein at least one tooth is mounted substantially parallel to the longitudinal axis of the base plate.

11. A connecting interface device according to claim 1, wherein the base plate is made out of a plastic material and according to a perforated structure.

12. A sports assembly comprising:

a sports apparatus; and a connecting interface device adapted to have a boot affixed with respect thereto and mounted pivotally on said sports apparatus which procures rear retention when climbing, said device comprising:

a plate including a fixing arrangement for the boot, an axle extending transversely to the apparatus, said plate being hingedly mounted on the apparatus by said axle;

a climbing wedge movable between at least two positions, said two positions including a raised position, which increases an inclination angle of said plate with respect to the apparatus, and a lowered position; and a base plate pivotally mounted, in relation to said plate, along an axis transverse to the apparatus, said base plate being arranged beneath said plate.

13. A sports assembly according to claim 12, wherein said sports apparatus comprises a ski.

14. A sports assembly according to claim 12, wherein said sports apparatus comprises a snowshoe.

* * * * *